United States Patent [19]

Powers

[11] Patent Number: 4,770,597

[45] Date of Patent: Sep. 13, 1988

[54] CLAMPING DEVICE FOR A BACKHOE

[76] Inventor: Richard S. Powers, 1528 Bellmeade, Copley, Ohio 44321

[21] Appl. No.: 66,470

[22] Filed: Jun. 26, 1987

[51] Int. Cl.[4] ..... E02F 3/28

[52] U.S. Cl. ..... 414/740; 37/117.5; 294/104

[58] Field of Search ..... 414/685, 722, 724, 729, 414/740, 912, 694, 686, 704, 622; 37/2 R, 117.5, DIG. 3, DIG. 12; 294/104

[56] References Cited

U.S. PATENT DOCUMENTS

| | | | |
|---|---|---|---|
| 3,275,172 | 9/1966 | Smith | 414/694 |
| 4,407,626 | 10/1983 | Bruckner | 414/722 X |
| 4,519,739 | 5/1985 | Risch | 37/DIG. 12 X |
| 4,548,543 | 10/1985 | Lenertz et al. | 414/686 |

FOREIGN PATENT DOCUMENTS

| | | | |
|---|---|---|---|
| 1183905 | 3/1970 | United Kingdom | 414/685 |

*Primary Examiner*—Robert J. Spar
*Assistant Examiner*—Donald W. Underwood
*Attorney, Agent, or Firm*—Arthur G. Yeager

[57] ABSTRACT

The combination of a dipper stick and pivotable bucket of a backhoe and a detachable, folding, clamping device attached to the dipper stick, the clamping device comprising an elongated jaw member pivotably attached to the distal end of the dipper stick and having a serrated member facing the bucket, the jaw member being pivotable to an operative position substantially perpendicular to the dipper stick and to an inoperative position parallel to and closely adjacent to the dipper stick; and a bracing support member pivotably attached to the free end of the jaw member and attachable to said dipper stick when in the operative position.

19 Claims, 1 Drawing Sheet

CLAMPING DEVICE FOR A BACKHOE

BACKGROUND OF THE INVENTION

Backhoes are well known earth moving vehicles particularly suited for digging holes and ditches in the ground. While these vehicles are admirably suited to dig in the earth and move loose dirt and small rocks, they are not well suited to pick up objects that do not fit easily in the bucket. For example, a slab of concrete, a large rock, a tree trunk, or a bundle of long sticks, may be larger than the dimensions of the bucket and such loads cannot be picked up easily by a backhoe. What is needed to provide this capability is a clamping element which works against the bucket movement in the same way a thumb opposes the fingers of a human hand in picking up items and moving them from place to place.

These problems have been addressed in the prior art and attempts to solve the problems have been described in U.S. Pat. Nos. 3,273,729 to Holopainen; 3,353,285 to Murray; 4,375,345 to Hanson; and 4,407,626 to Bruckner. Two of these patents employ a hydraulically powered movable jaw to oppose the movement of the backhoe bucket. The other two employ a fixed clamping jaw against which the bucket can be moved to clamp items therebetween. Each of these improvements has some disadvantage that prevents it from being fully useful on a small backhoe for performing all types of pick-up tasks.

It is an object of this invention to provide a novel clamping device for a backhoe. It is another object of this invention to provide a simple, detachable, fixed clamping jaw for a backhoe. Still other objects will appear from the more detailed description which follows.

BRIEF DESCRIPTION OF THE INVENTION

The invention relates to a combination of a clamping device with the dipper stick and pivotable bucket of a backhoe, which comprises an elongated jaw member pivotably attached at one end to the distal end of the dipper stick adjacent the pivot of the bucket and at the other end to a bracing member which is detachably attached to the dipper stick remote from the bucket so as to form a triangle with the jaw member, the bracing member, and the dipper stick; the jaw member having a serrated element adjacent its connection to the bracing member and facing the bucket; the jaw member and the bracing member being foldable to lie in an elongated position along the dipper stick.

In a preferred embodiment of the invention, the clamping device is assembled by removable pins which can be employed to disassemble the device and remove it from the backhoe or fold it against the dipper stick so as not to interfere with the normal digging operations of the backhoe.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 5:
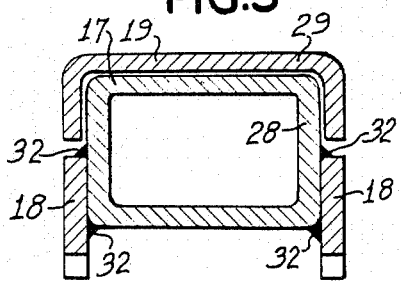
FIG. 5 is a cross sectional view taken at 5—5 of FIG. 3.

The various figures of the drawing illustrate the features of the device according to this invention. The backhoe to which this device is applied is not shown completely since it is well known in the prior art. The only portions of the backhoe that are illustrated here are the dipper stick or boom 10, the bucket 11 which pivots around pin 12, and the hydraulic cylinder 13 and its ram 14 which cause the bucket to pivot in a manner well known in the prior art. The present device acts in combination with these components of the backhoe to provide a novel and useful result.

The device in accord with the invention comprises a clamping jaw member 17, a bracing member 19, and the associated components for attachment to the backhoe. Clamping jaw member 17 preferably is an elongated square tubular member which is positioned substantially perpendicular to the underneath surface 30 of the dipper stick 10 adjacent the distal end thereof where bucket 11 is attached. Clamping jaw member 17 is substantially the same length or slightly greater than the distance from surface 30 to bucket tip 31 along a line perpendicular to surface 30. This length of jaw 17 will then assure its ability to cooperate with bucket tip 31 in picking up objects from the ground. The lower or outer portion, i.e., away from dipper stick 10, of clamping jaw 17 has at least one serrated portion 18 attached thereto to provide a jagged, toothed surface against which bucket 11 can squeeze an object to pick it up without slipping. Clamping jaw member 17 preferably is a square tubular beam with two serrated members 18 welded to the end of jaw member 17 so that the serrations, or teeth project toward bucket 11.

In order to stiffen clamping jaw member 17 against the forces applied by bucket 11 in picking up all types of objects or loads, a bracing member 19 is placed at an angle behind clamping jaw 17 and attached to dipper stick 10. This produces the triangular structure design that is well known to provide high strength. Bracing member 19, preferably is a channel beam structure which is sufficiently wide to receive jaw member 17 within the channel when folded in the inoperative position as in FIG. 2. The nesting of jaw member 17 within bracing member 19 is shown in FIG. 5.

Figure 3:
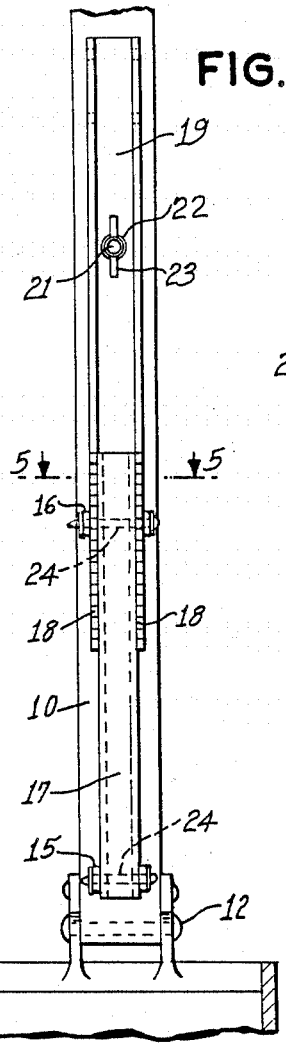
FIG. 3 is a rear elevational view taken in the direction of 3—3 of FIG. 2.
Figure 4:
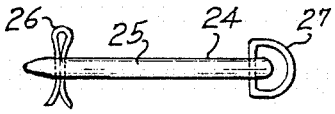
FIG. 4 is an illustrative view of a prior art pull pin employed in assembling and disassembling the device on a dipper stick.
Figure 1:
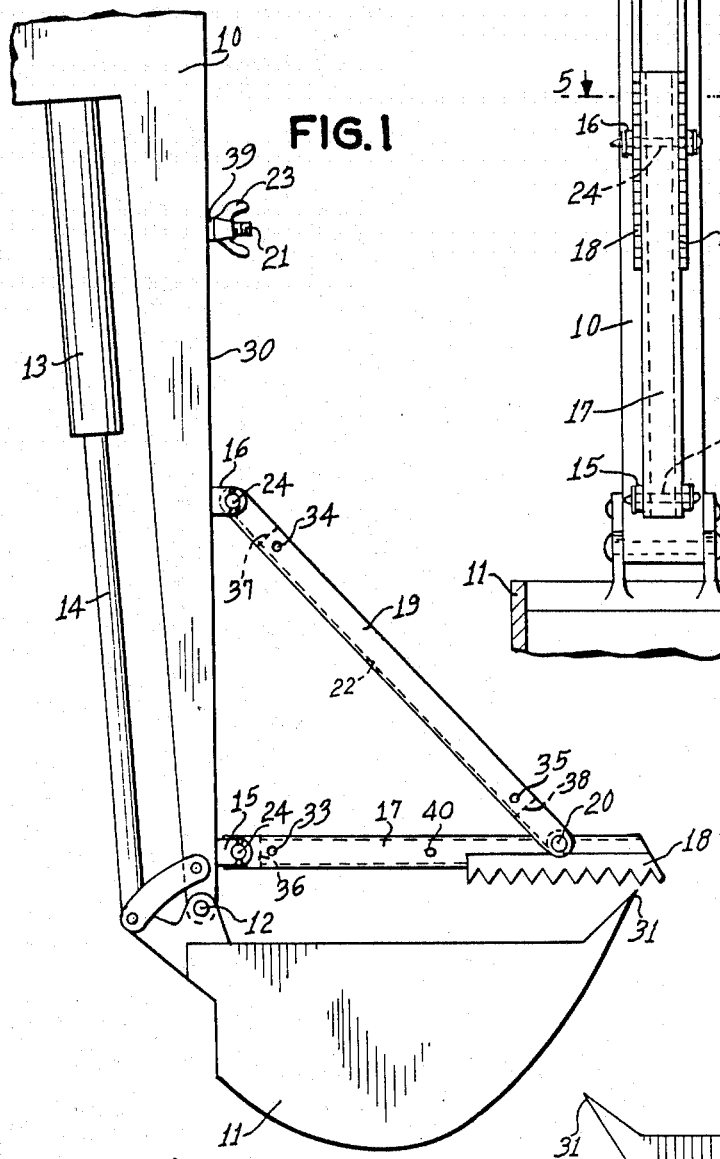
FIG. 1 is a right side view in elevation of the device of this invention in operational position.
Figure 2:
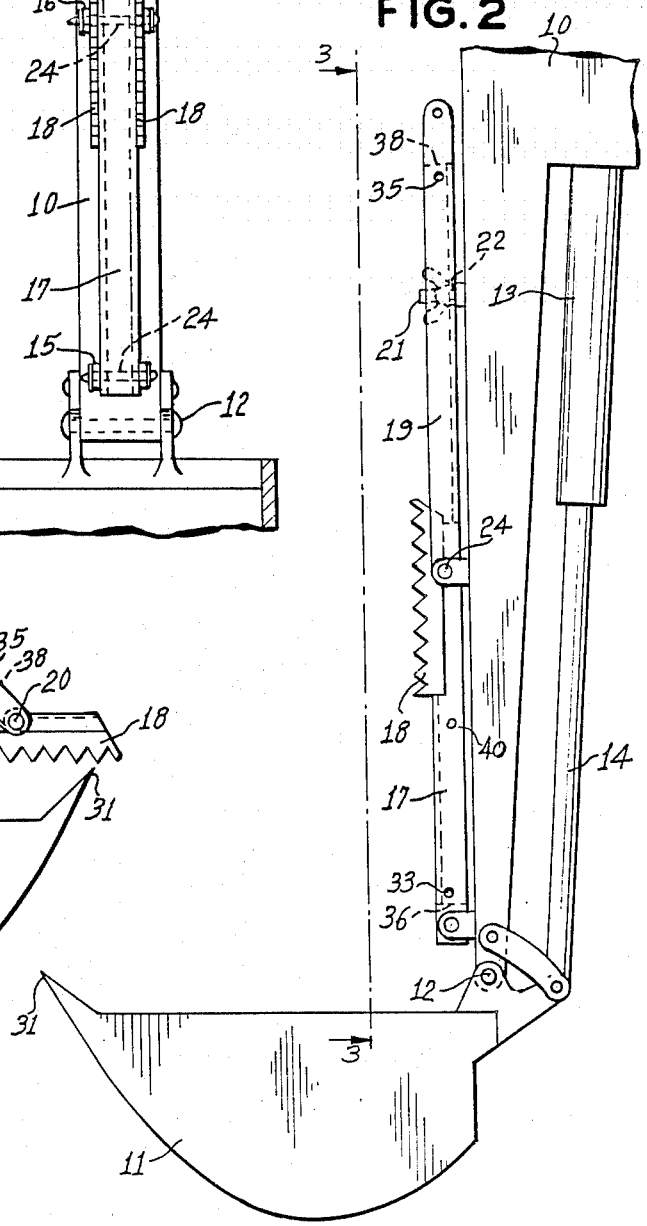
FIG. 2 is a left side view in elevation of the device of this invention in the folded non-operational position.

Since it is preferred for clamping jaw member 17 to be detachable and/or collapsible (as shown in FIG. 2) the components 17 and 19 are assembled with pivot pin structures. On the underneath surface 30 of dipper stick 10 there are affixed, as by welding or bolting, pivot supports 15 and 16 which, preferably, are bifurcated and adapted to receive respective members 17 and 19, between the bifurcated portions, joined together by pivot pins 24. Pivot pins 24 are well known in the prior art and shown in FIG. 4 to be a pin of sufficient size in the shank portion 25 to withstand the forces developed in the use of this invention, with a pull ring 27 at one end and a keeper clip or cotter pin 26 at the other end. Thus, by removal of clip 26 from shank 25 and pulling on ring 27, pin 24 can be quickly removed from brackets 15 or 16 to remove clamping jaw member 17 and bracing member 18 from dipper stick 10. Pivot connection 20, between jaw member 17 and bracing member 19 preferably, is not disassembled when folding jaw member 17 and bracing member 19 t the inoperative position. This connection, however, may use a pin 24 so that all members may be disconnected from each other. When pins 24 are in place in brackets 15 and 16, clamping jaw member 17 and bracing member 19 are in the operational position as shown in FIG. 1. If pivot pins 24 are removed from supports 15 and 16 the structure of clamping jaw member 17 and bracing member 19 can be completely removed from the backhoe, leaving only brackets 15 and 16 attached to dipper stick 10. In accord with the invention, the clamping jaw structure can be folded against underneath surface 30 by removing pivot pin 24 from bracket 16 only so that the structure can then be folded to the position shown in FIGS. 2 and 3. It is preferred to employ a short bolt 21 welded to strap 39 which is welded to boom 10 to cooperate with hole 22 in bracing member 19, and an appropriate wing nut 23 is screwed on to hold the structure in its folded position. Strap 39 may or may not be needed depending on the need for it to make the folded elements 17 and 19 parallel to surface 30. Other methods of maintaining the folded structure against dipper stick 10 out of the way of bucket 11 for its normal digging operations may be devised.

In FIG. 5 there is shown the manner in which clamping jaw member 17 nests within bracing member 19 when in the folded inoperative position and held as closely as possible to underneath surface 30 of dipper stick 10 so as to be completely out of the way when bucket 11 is used for digging or other normal operations of the backhoe machine. Clamping jaw member 17 is made of a square tubular beam 28 with serrated teeth portions 18 welded thereto as at 32. Bracing member 19 is a channel structure which is wide enough for.the square tubular beam 28 to nest therein and take up as little space as possible when folded as shown at FIG. 2.

The lengths of jaw member 17 and bracing member 19 and the positioning of holes for pivot 20 and connections at brackets 15 and 16 must, of course, be varied for different sizes and makes of backhoe machinery. There are occasions, however, when a particular backhoe operator may wish to use a smaller bucket 11 than the one used previously, or to provide more compact folding of the components when not used. Accordingly, jaw member 17 and bracing member 19 are provided with holes 33, 34, 35 and 40 and with marked cut-off lines 36, 37 and 38. For a smaller bucket than bucket 11 of FIGS. 1 and 2 jaw member 17 may be cut off at line 36 and hole 33 used in bracket 15 to form a pivot with pin 24. Similarly, bracing member 19 may be cut off at line 37 so that hole 34 may be used in bracket 16 to form a pivot with pin 24. Alternatively member 19 may be cut off at line 38 to permit hole 35 to be used in forming pivot connection 20. These holes 34 and 35 and cut-off lines 37 and 38 may also be used to accommodate the use of shorter dipper sticks 10 or changed placement of bracket 16. Hole 40 may be used as an alternate for pivot connection 20.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A clamping device for attachment to the dipper stick of a backhoe for cooperation with the pivotable bucket thereof, said device comprising an elongated jaw member having a lower end pivotably attached to the distal end of a dipper stick adjacent a pivot of a bucket and extending laterally outwardly from said dipper stick to an upper end, an elongated bracing member having a lower end pivotably attached to said upper end of said jaw member and an upper end releasably attachable to said dipper stick so as to form a triangle with said jaw member and dipper stick, said jaw member including an elongated hollow box structure and only a pair of spaced serrated sections attached to each side of said box structure adjacent said upper end thereof so as to form teeth facing said bucket.

2. The clamping device of claim 1 further comprising a plurality of removable pins for releasably attaching said jaw member to said bracing member and to said dipper stick.

3. The clamping device of claim 2 further comprising a retaining means to maintain said jaw member and said bracing member in an inoperative elongated position along and against said dipper stick.

4. The clamping device of claim 3 wherein said retaining means includes a threaded member attached to said dipper stick, a passageway in said bracing member for said threaded member to project therethrough, and a nut to mate with said threaded member outwardly of said bracing member to firmly, releasably secure and bracing member in such inoperative position.

5. The clamping device of claim 1 further comprising a pair of spaced bifurcated pivot supports rigidly attached to said dipper stick, one of said supports being positioned adjacent the distal end of said dipper stick and being adapted to receive said jaw member between its bifurcated portions, a pivot pin extending laterally through aligned passages through said sides of said box structure and in each of said bifurcated portions, and another of said supports being positioned inwardly from said distal end of said dipper stick and adapted to receive said bracing member between its bifurcated portions and a pivot pin extending laterally through aligned passageways through said bracing member and through said bifurcated portions.

6. The clamping device of claim 1 wherein said box structure is rectangular and said bracing member is a channel structure having a base and a pair of upstanding side walls.

7. The clamping device of claim 6 wherein said channel structure is adapted to nestingly receive said box structure therewithin, one wall of said rectangular box structure being juxtaposed with said base of said channel structure and a pair of walls connected to said one wall of said rectangular structure being adjacent respective side walls of said channel structure to position said jaw member and said bracing member in an inoperative position closely along and against said dipper stick.

8. The clamping device of claim 1 wherein said jaw member extends outwardly beyond the largest radius subscribed by the bucket in its pivoting movement.

9. A combination comprising a dipper stick and a pivotable earth moving bucket mounted on a distal end of a dipper stick and a detachable rigid clamping device adapted to cooperate with said bucket in picking up any of a variety of objects, said dipper stick having an underneath side, said earth moving bucket being pivotally mounted on said dipper stick to pivot away from and toward said underneath side thereof; two spaced pivot pin supports on said underneath side of said dipper stick, one of said supports being located adjacent said distal end and another of said supports being spaced away from said distal end, an elongated clamping jaw member having a rectangular tubular hollow cross section of four sides and a pair of end portions, said clamping jaw member being positionable in its operative position substantially perpendicular to said underneath side of said dipper stick, means for attaching one said end portion of said clamping jaw member to said one pivot pin support, a pivot connection attached to a backside of said clamping jaw spacedly away from said dipper stick, said clamping jaw member including only a pair of elongated serrated members attached along each space side at right angles with respect to said backside spacedly away from said dipper stick with the serrations of said clamping jaw member facing said pivotable bucket, and an elongated stiff bracing member attached at one of its ends to said pivot connection on said backside of said clamping jaw member and at the other of its ends to said other pivot support on said dipper stick remote from the distal end thereof.

10. The combination of claim 9 wherein each of said two spaced pivot pin supports is adapted to receive a removable lateral pin through said support and through respective said member supported thereby.

11. The combination of claim 9 further comprising fastening means attached to said dipper stick, said bracing member being a channel structure including a passageway through a base portion thereof which is adapted to mate with said fastening means when said bracing member and said clamping jaw member are folded substantially parallel to and closely adjacent said underneath side of said dipper stick in an inoperative position completely unencumbering the use of said dipper stick and bucket in their normal functions.

12. The combination of claim 11 wherein said fastening means includes a threaded member affixed to said dipper stick and a wing nut threaded thereon beneath said base portion of said channel structure, said channel member closely nestingly receiving between its sides said rectangular tubular clamping jaw member to minimize the lateral extent thereof beneath said dipper stick in said inoperative position 13. A clamping device for attachment to a dipper stick of a backhoe for cooperation with a pivotable bucket thereof, said device comprising an elongated jaw member having a lower end pivotably attachable to a distal end of a dipper stick adjacent a pivot of a bucket and extending laterally outwardly therefrom to an upper end, an elongated bracing member having a lower end pivotable attached to said upper end of said jaw member and an upper end releasably attachable to a dipper stick spacedly away from a distal end thereof so as to form a triangle with said jaw member and a dipper stick, said jaw member being a hollow rectangular tubular structure having side faces, an elongated serrated jaw section attached along and only to each of said side faces adjacent said upper end thereof so as to form teeth facing a bucket on a dipper stick.

14. The clamping device of claim 13 further comprising a plurality of removable pins for releasably attaching said jaw member to said bracing member and to a dipper stick.

15. The clamping device of claim 14 further comprising retaining means for maintaining said jaw member and said bracing member in an inoperative elongated position substantially parallel along and closely adjacent against a dipper stick to which said device is mountable.

16. The clamping device of claim 15 wherein said retaining means includes a threaded member attached to a dipper stick, a passageway in said bracing member for said threaded member to project therethrough, and a nut to mate with said theaded member outwardly of said bracing member to firmly, releasably secure said bracing member in such inoperative position.

17. The clamping device of claim 13 further comprising a pair of spaced bifurcated pivot supports rigidly attached to a dipper stick, one of said supports being positioned adjacent the distal end of said dipper stick and being adapted to receive said jaw member between its bifurcated portions, a pivot pin extending laterally through aligned passages through said sides of said box structure and in each of said bifurcated portions, and another of said supports being positioned inwardly from said distal end of said dipper stick and adapted to receive said bracing member between its bifurcated portions and a pivot pin extending laterally through aligned passageways through said bracing member and through said bifurcated portions.

18. The clamping device of claim 17 wherein said bracing member is a channel structure adapted to receive said tubular structure in a nesting position therewithin, further comprising retaining means for maintaining said tubular structure in its nested position in an inoperative elongated position substantially parallel to and closely adjacent a dipper stick to which said device is mountable.

19. The clamping device of claim 18 wherein said jaw member extends outwardly beyond at least to a largest radius subscribed by a bucket in its pivoting movement on a dipper stick.

* * * * *